US010895390B2

(12) United States Patent
Aquino

(10) Patent No.: US 10,895,390 B2
(45) Date of Patent: Jan. 19, 2021

(54) DUAL WINDOW FAN

(71) Applicant: Antonio Aquino, Los Angeles, CA (US)

(72) Inventor: Antonio Aquino, Los Angeles, CA (US)

( * ) Notice: Subject to any disclaimer, the term of this patent is extended or adjusted under 35 U.S.C. 154(b) by 247 days.

(21) Appl. No.: 16/036,266

(22) Filed: Jul. 16, 2018

(65) Prior Publication Data

US 2020/0018498 A1 Jan. 16, 2020

(51) Int. Cl.

| | |
|---|---|
| ***F24F 7/013*** | (2006.01) |
| ***F24F 11/79*** | (2018.01) |
| ***F24F 11/00*** | (2018.01) |
| *F24F 110/10* | (2018.01) |

(52) U.S. Cl.

CPC ..... *F24F 7/013* (2013.01); *F24F 11/0001* (2013.01); *F24F 11/79* (2018.01); *F24F 2110/10* (2018.01)

(58) Field of Classification Search

CPC ..... F24F 11/0001; F24F 11/74; F24F 11/79; F24F 2110/12; F24F 7/013

See application file for complete search history.

(56) References Cited

U.S. PATENT DOCUMENTS

| | | | | |
|---|---|---|---|---|
| 3,753,184 | A | 8/1973 | Holloway et al. | |
| 3,799,245 | A | 3/1974 | Ferdelman | |
| 4,018,266 | A | 4/1977 | Kay | |
| 4,136,822 | A | 1/1979 | Felter | |
| 4,773,310 | A * | 9/1988 | Corwin | F24F 3/1603 454/210 |
| 4,987,952 | A | 1/1991 | Beal et al. | |
| 5,000,381 | A | 3/1991 | Mueller et al. | |
| 5,005,636 | A | 4/1991 | Haessig | |
| 5,065,585 | A | 11/1991 | Wylie et al. | |
| 5,239,834 | A | 8/1993 | Travers | |
| 5,626,288 | A | 5/1997 | Huber | |
| 6,283,851 | B1 | 9/2001 | Smith et al. | |
| 6,364,024 | B1 | 4/2002 | Dallas | |
| 6,388,878 | B1 * | 5/2002 | Chang | G06F 1/20 361/679.48 |
| 8,079,898 | B1 | 12/2011 | Stevenson | |
| 8,118,236 | B2 | 2/2012 | Lestage et al. | |
| 8,156,797 | B2 | 4/2012 | Murray et al. | |
| 8,543,244 | B2 | 9/2013 | Keeling et al. | |
| 2006/0273183 | A1 | 12/2006 | Cavanagh et al. | |
| 2008/0054085 | A1 | 3/2008 | Case | |
| 2009/0013703 | A1 | 1/2009 | Werner | |
| 2009/0014545 | A1 | 1/2009 | Horiuchi | |
| 2011/0159795 | A1 | 6/2011 | Sprague | |

(Continued)

FOREIGN PATENT DOCUMENTS

| | | | | |
|---|---|---|---|---|
| JP | 2000121132 | A * | 4/2000 | F24F 1/0035 |

*Primary Examiner* — Steven S Anderson, II
(74) *Attorney, Agent, or Firm* — Averill & Green; Kenneth L. Green

(57) ABSTRACT

A wall mount (for example, a window mount) dual fan includes two independently controlled fans controllable to move air in the same direction or in opposite directions. Each fan includes a temperature sensor to measure temperature of air moving through each fan. The fans are energized periodically for a short time period to make accurate temperature measurements. When the combined temperature measurements indicate an advantage from fan operation, the fans are activated.

19 Claims, 6 Drawing Sheets

(56) References Cited

U.S. PATENT DOCUMENTS

| | | | | |
|---|---|---|---|---|
| 2012/0190292 | A1 | 7/2012 | Skrepcinski | |
| 2015/0184884 | A1* | 7/2015 | Aquino | F24F 11/76<br>165/250 |
| 2015/0285524 | A1* | 10/2015 | Saunders | F24F 11/77<br>454/239 |

* cited by examiner

DUAL WINDOW FAN

BACKGROUND OF THE INVENTION

The present invention relates to room temperature control and in particular to wall mounted fans.

Wall mounted fans are often used to provide cool outside air to a room when cooling is desired, or warm outside air to a room when heating is desired. The fans generally compare room temperature to a temperature setting, and activate the fan when the room temperature exceeds the setting for cooling and activate the fan when room temperature is less than the setting for heating. In many instances, the fan is operated when outside air is above the inside air temperature when cooling is desired or below the inside air temperature when heating is desired, providing an undesirable result.

BRIEF SUMMARY OF THE INVENTION

The present invention addresses the above and other needs by providing a wall (or window) mount dual fan which includes two independently controlled fans controllable to move air in the same direction or in opposite directions. Each fan includes a temperature sensor to measure temperature of air moving through each fan. The fans are energized periodically for a short time period to make accurate temperature measurements. When the combined temperature measurements indicate an advantage from fan operation, the fans are activated.

In accordance with one aspect of the invention, there is provided a method for controlling a dual fan for heating a room. The method includes setting the dual fan to heating. Selecting a desired heating temperature setting. Briefly operating fans in opposing directions to create opposing air flow in and flow out. Measuring the temperature To in the flow in and Ti in the flow out. If the room temperature is below the heating temperature setting, and To is greater than Ti, operating the dual fan to bring in outside air.

In accordance with another aspect of the invention, there is provided method for controlling a dual fan for cooling a room. The method includes setting the dual fan to cooling. Selecting a desired cooling temperature setting. Briefly operating fans in opposing directions to create opposing air flow in and flow out. Measuring the temperature To in the flow in and Ti in the flow out. If the room temperature is above the cooling temperature setting, and To is less than Ti, operating the dual fan to bring in outside air.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1A:
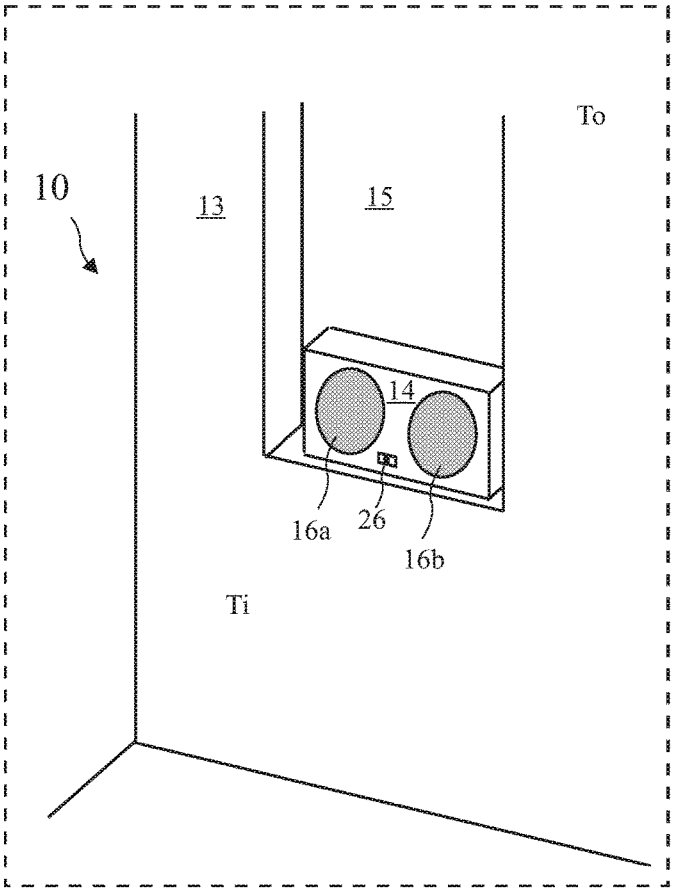
FIG. 1A shows rooms including a dual wall fan according to the present invention.
Figure 1B:
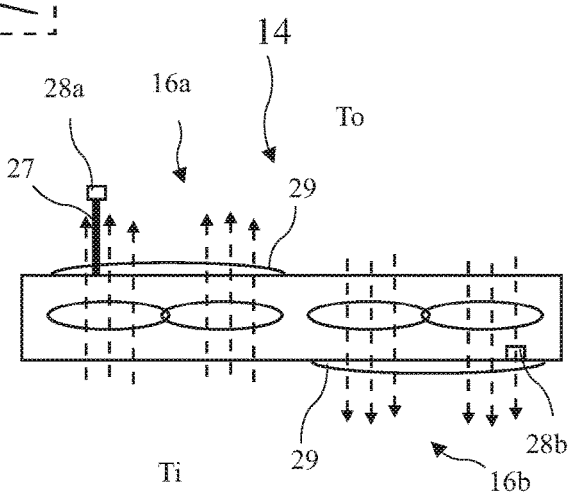
FIG. 1B shows a top view of the dual wall fan according to the present invention.

A temperature controlled area 10 including a dual wall fan (for example a window fan) 14 according to the present invention are shown in FIG. 1A and a top view of the dual wall fan 14 in operation is shown in FIG. 1B. The dual wall fan 14 is mounted to an external wall 13, preferably in windows 15. The dual wall fan 14 includes controls 26, preferably as part of dual wall fan 14 (but may be wired or wireless remote controls), electrically connected (wired or wirelessly) to a processor 50 (see FIG. 6). The controls 26 allow a user to select heating or cooling and a temperature target Tt determining if and when the wall fan 14 will be utilized. Further, in one embodiment, the user sets a lower temperature Tl and a higher temperature Th further determining if and when the wall fan 14 will be utilized.

The fans 16*a* and 16*b* are operated periodically in opposite directions and an outdoor temperature sensor 28*a* measures outdoor temperature To in an air flow out of the room due to one of the fans 16*a* or 16*b*, and in indoor temperature sensor 28*b* measures an indoor temperature Ti in an air flow into the room due to the other one of the fans 16*a* or 16*b*. The sensors 28*a* and 28*b* may be inside the dual wall fan 14, on grills 29 of the dual wall fan 14, or extended on rods 27 reaching into and out of the room 13. The temperatures Tt, Tl and Th, To, and Ti are all provided to a processor 50 (see FIG. 6).

The processor 50 determines if the wall fan 14 should be energized or de-energized, based on the method of FIGS. 2-5. The sensors 28*a* and 28*b* are electrically connected to the controls 26. The controls 26 controls power provided to the dual wall fan 14.

Figure 2:
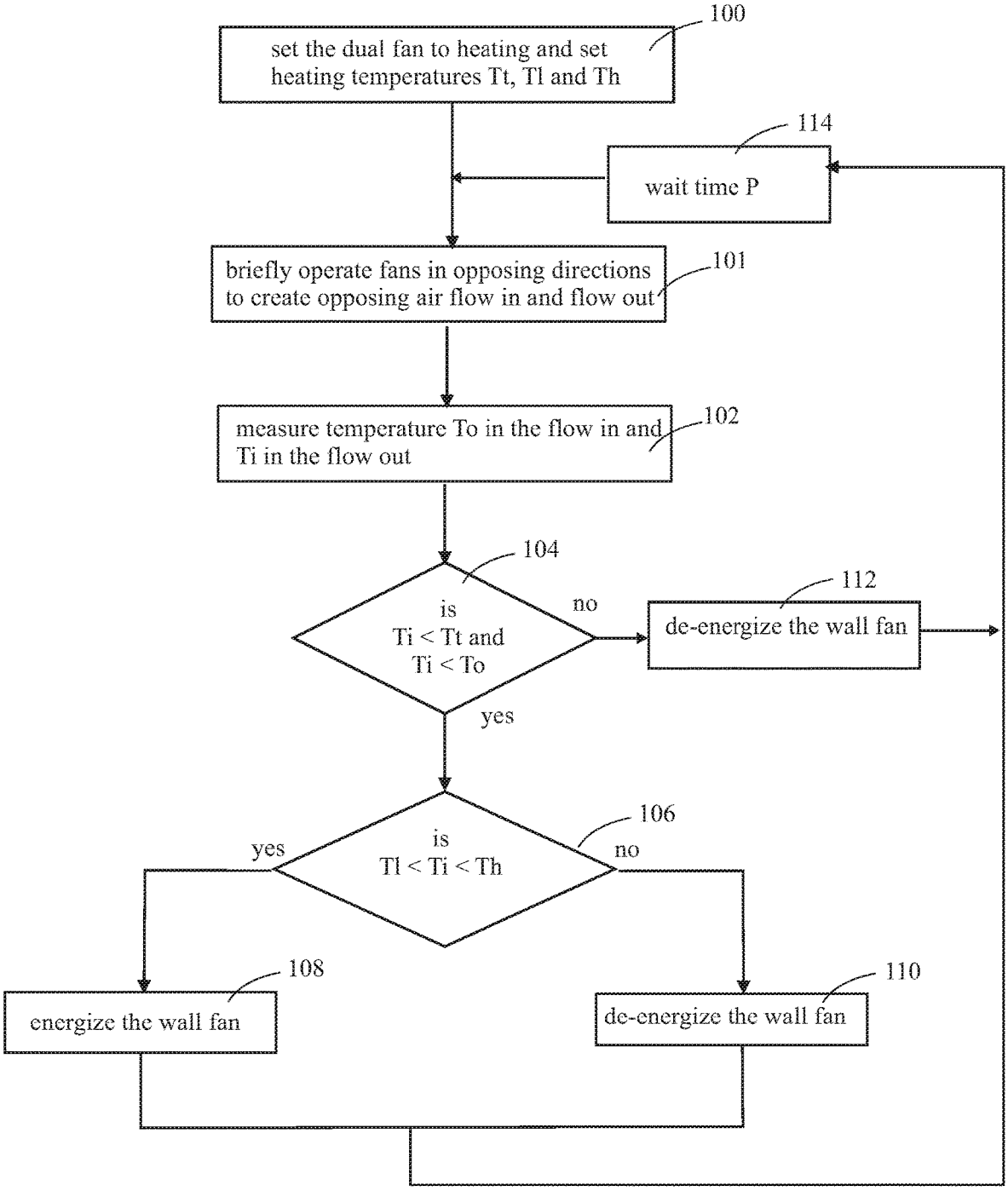
FIG. 2 shows a heating method according to the present invention.

FIG. 2 shows a heating method according to the present invention. The method includes: setting heating mode, a target temperature Tt, a low temperature Tl, and a high temperature Th at step 100; briefly, for a sample period of time (for example, for five seconds), operate fans in opposing directions to create opposing air flow in and flow out at step 101; measuring an outdoor temperature To and an indoor temperature Ti at step 102; comparing Ti to Tt, and To and Ti at step 104; If Ti is not less than Tt, or To is not greater than Ti at step 104, de-energize the wall fan at step 112, waiting a period of time P at step 114, and then repeating measuring the outdoor temperature To and the indoor temperature Ti, otherwise, if Ti is less than Tt (heating is desired) and To is greater than Ti (i.e., can use outdoor air to heat the room), then if Tl is less than Ti and Ti is less than Th at step 106, energizing the wall fan at step 108 or alternatively de-energizing the wall fan at step 110, and after the period of time P at step 114, again briefly operating the fans and measuring the outdoor temperature To and the indoor temperature Ti and repeating steps 104 through 110. The temperature Tl is a lower preferred indoor temperature and the temperature Th is a higher preferred indoor temperature. The sample period of time is preferably between three and ten seconds, and is more preferably five seconds. The waiting time P is preferably between 15 and 30 minutes, and more preferably 20 minutes.

Figure 3:
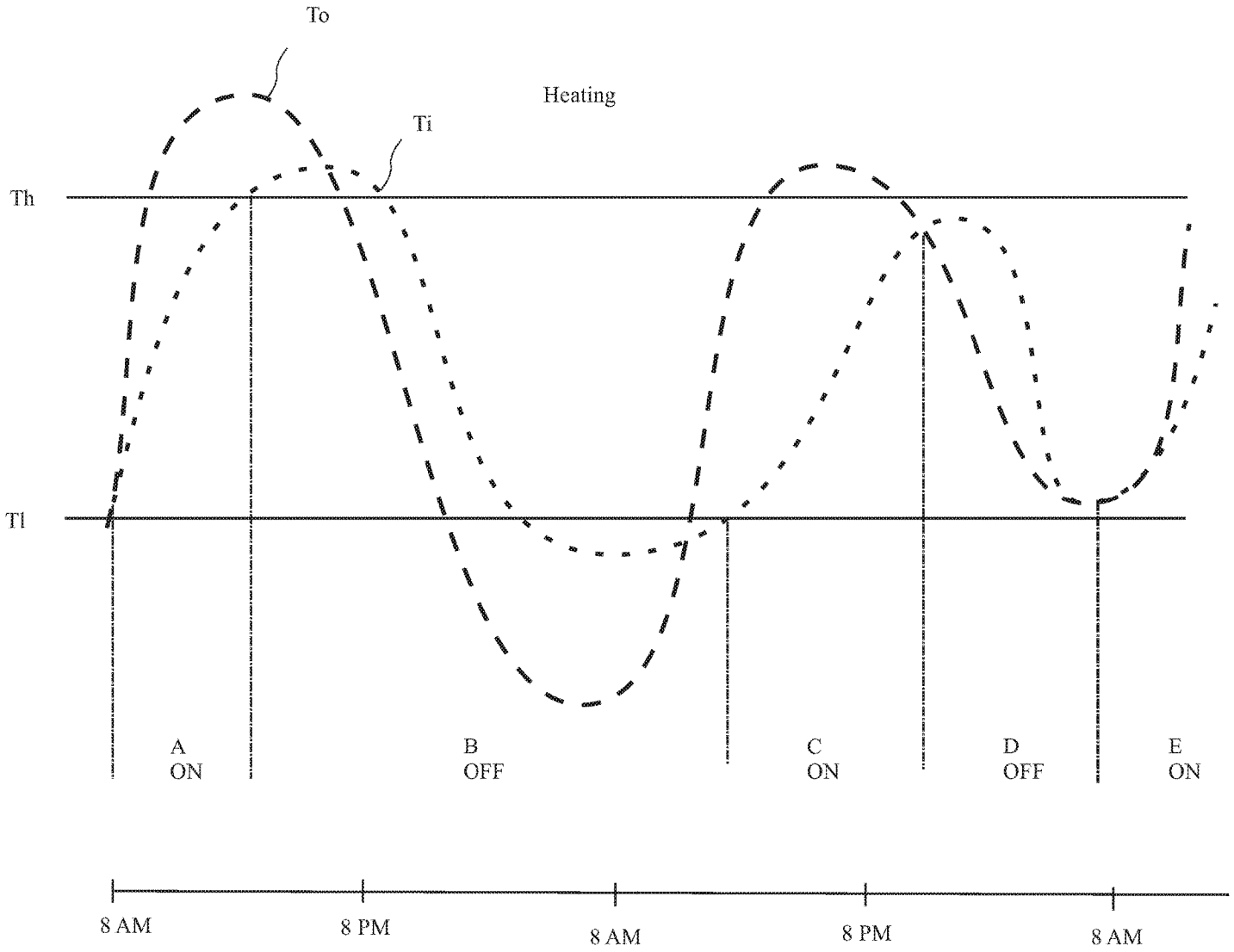
FIG. 3 shows the operation of the heating method according to the present invention in operation.

FIG. 3 shows the method of FIG. 2 controlling a wall fan in heating mode when heating desired. In interval A Ti is between Tl and Th, and To is greater than Ti, so the wall fan is energized to take advantage of the outdoor air to heat the room. During interval B Ti is greater than Th, or To is less than Ti and the wall fan is de-energize. During interval C Ti remains between Tl and Th and To is greater than Ti, so the wall fan is energized to take advantage of the outdoor air to heat the room. During interval D To is less than Ti and the wall fan is de-energized. During interval E, Ti remains between Tl and Th and To is greater than Ti, so the wall fan is energized to take advantage of the outdoor air to heat the room.

Figure 4:
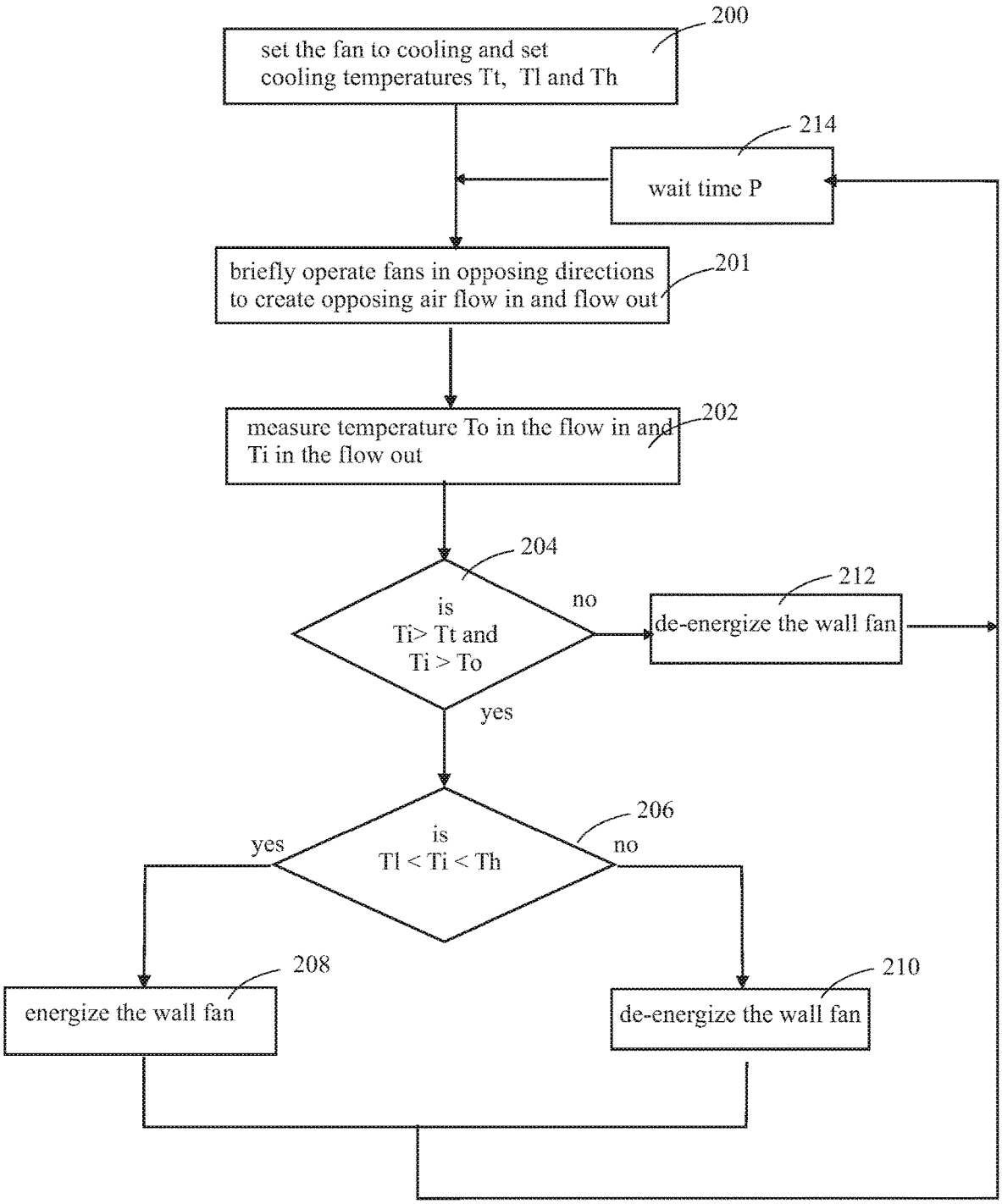
FIG. 4 shows a cooling method according to the present invention

FIG. 4 shows a cooling method according to the present invention. The method includes: setting cooling mode, a target temperature Tt, the lower temperature Tl, and the higher temperature at step 200; briefly, for the sample period of time, operating fans in opposing directions to create opposing air flow in and flow out at step 201; measuring an outdoor temperature To and an indoor temperature Ti at step 202; comparing Ti to Tt and Ti and To at step 204; If Ti is not greater than Tt or Ti is not greater than To at step 204, de-energize the wall fan at step 212, waiting a period of time P at step 214, and then repeating measuring the outdoor temperature To and the indoor temperature Ti, otherwise, if Ti is greater than Tt (cooling is desired), and Ti is greater than To (i.e., can use outdoor to cool the room), if Tl is less than Ti and Ti is less than Th at step 206, energize the dual wall fan at step 208 or alternatively de-energize the dual wall fan at step 210, and after the period of time P at step 214, again briefly operating fans and measuring the outdoor temperature To and the indoor temperature Ti and repeating steps 204 through 210.

Figure 5:
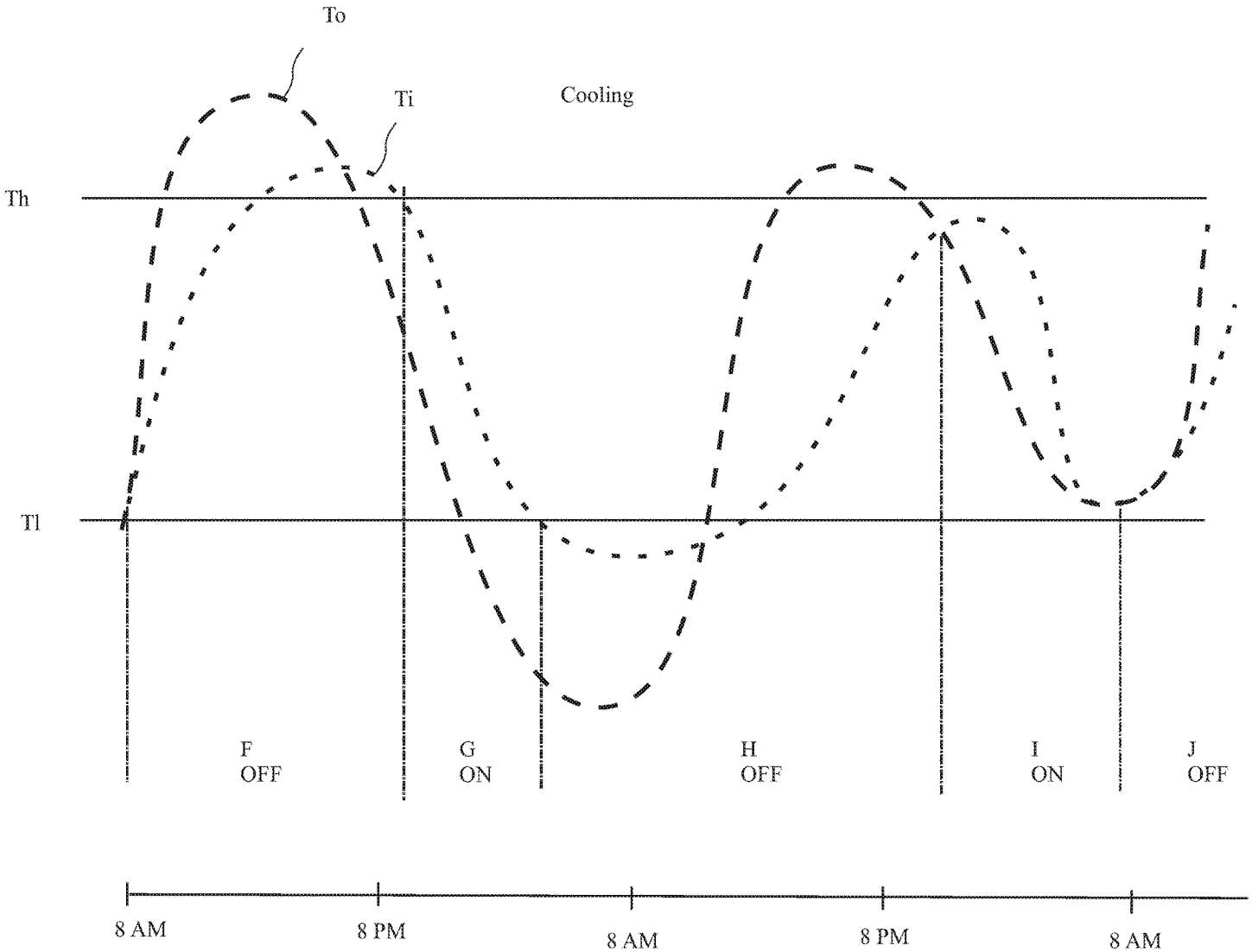
FIG. 5 shows the operation of the cooling method according to the present invention.

FIG. 5 shows the method of FIG. 4 controlling a wall fan in cooling mode when cooling is desired and cool outside air is available. In interval F, either To is greater than Ti or Ti is greater than Th, so the wall fan is de-energized. During interval G, Ti is between Tl and Th, and To is less than Ti so the wall fan is energized to take advantage of cooler outdoor air. During interval H, either Ti is less than Tl or To is greater than Ti, so the wall fan is de-energized. During interval I, Ti is between Tl and Th, and To is less than Ti so the wall fan is energized to take advantage of cooler outdoor air. During interval J, To is greater than Ti, so the wall fan is de-energized.

Figure 6:
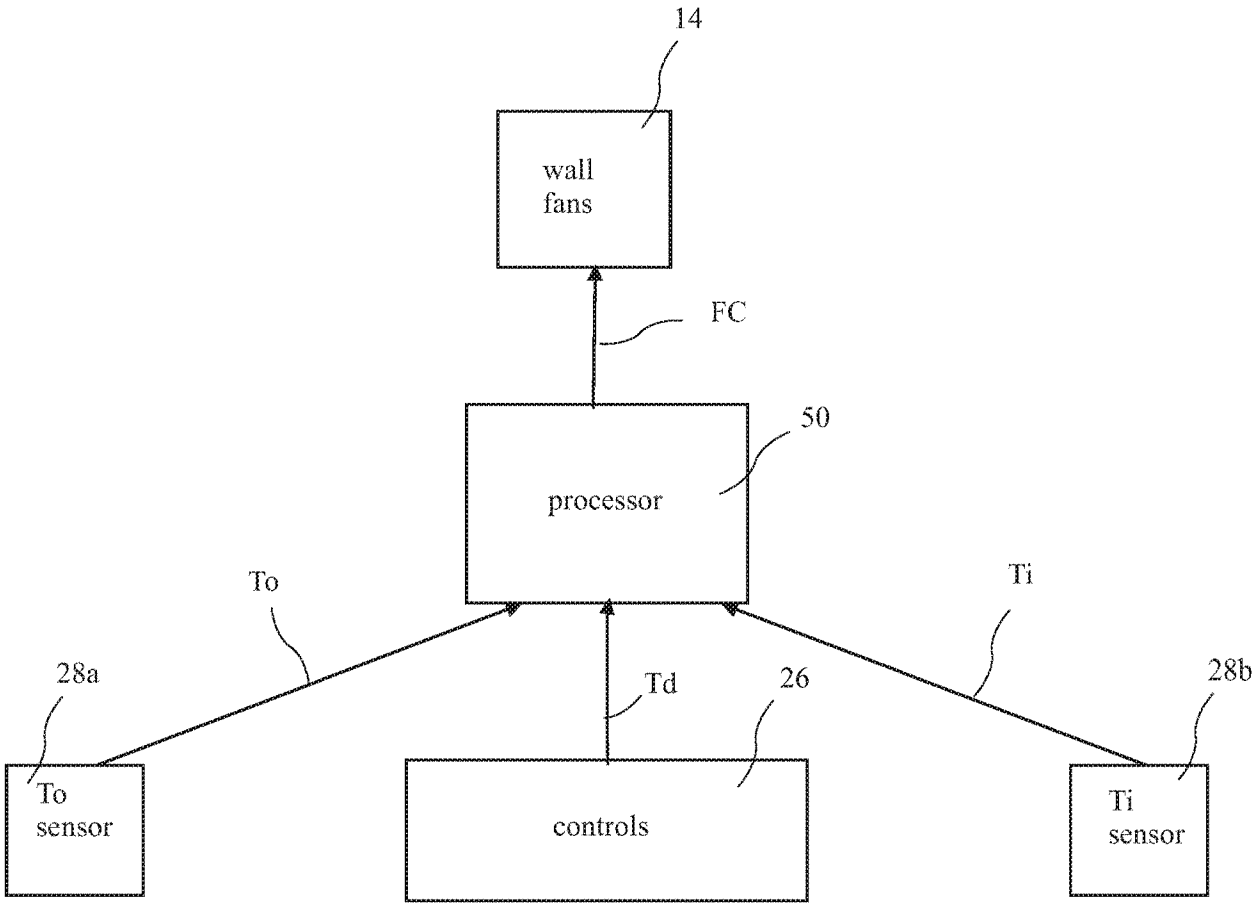
FIG. 6 shows a circuit according to the present invention.

A circuit according to the present invention for controlling the dual wall fan 14 is shown in FIG. 6. The controls 26, sensors 28*a* and 28*b*, and dual wall fan 14 may be connected by wires or be wireless, for example BLUETOOTH®, wireless communications.

While the invention herein disclosed has been described by means of specific embodiments and applications thereof, numerous modifications and variations could be made thereto by those skilled in the art without departing from the scope of the invention set forth in the claims.

I claim:

1. A dual wall mount fan, comprising:

a housing configured to mount in a wall of a temperature controlled room;

an independently controlled first fan in the housing;

an independently controlled second fan in the housing;

a first temperature sensor positioned to sense an indoor air temperature Ti in an air flow created by the first fan;

a second temperature sensor positioned to sense an outdoor air temperature To in an air flow created by the second fan;

a user operated control configured to allow a user to input heating mode or cooling mode and a target temperature Tt;

a processor operatively connected to the control, the indoor temperature sensor, the outdoor temperature sensor, the first fan, and the second fan, the processor configured to:

operate the first fan for a sample period of time to draw air from inside a temperature controlled room, providing a first air flow past the first temperature sensor;

receive an indoor temperature Ti of the first air flow from the first temperature sensor;

operate the second fan for the sample period of time to draw air from outside the temperature controlled room, providing a second air flow past the second temperature sensor;

receive the outdoor temperature To of the second air flow from the second temperature sensor;

compare the indoor temperature Ti to the target temperature Tt;

compare the indoor temperature Ti to the outdoor temperature To;

if a first criteria comprising: in the heating mode, the indoor temperature Ti is less than the target temperature Tt, and the indoor temperature Ti is less than the outdoor temperature To is met, provide signals to activate the first fan and the second fan to draw outside air into the temperature controlled room; and if a second criteria comprising: in the cooling mode, the indoor temperature Ti is greater than the target temperature Tt, and the indoor temperature Ti is greater than the outdoor temperature To is met, provide signals to activate the first fan and the second fan to draw outside air into the temperature controlled room.

2. The dual wall mount fan of claim 1, wherein the processor is configured to periodically test for the first criteria and the second criteria after a waiting time interval, and to activate the first fan and the second fan if either the first criteria or the second criteria is met, otherwise, deactivate the first fan and the second fan.

3. The dual wall mount fan of claim 2, wherein the waiting time is between 15 and 30 minutes.

4. The dual wall mount fan of claim 3, wherein the waiting time is 20 minutes.

5. The dual wall mount fan of claim 1, wherein the sample period of time is between three seconds and 10 seconds.

6. The dual wall mount fan of claim 5, wherein the sample period of time is five seconds.

7. The dual wall mount fan of claim 1, wherein:

the control is further configured to allow a user to input a lower temperature Tl and a higher temperature Th; and the processor is configured to deactivate the first fan and the second fan when the indoor temperature Ti is not between the lower temperature Tl and the higher temperature Th.

8. The dual wall mount fan of claim 1, wherein the housing is mounted in a window.

9. The dual wall mount fan of claim 1, wherein either the first temperature sensor or the second temperature sensor is attached outside the housing to an end of a rod extending from the housing.

10. A method for controlling room temperature, comprising:

mounting a dual wall mount fan in a wall of an temperature controlled room, the dual wall mount fan comprising:

an independently controlled first fan in the housing;

an independently controlled second fan in the housing;

a first temperature sensor;

a second temperature sensor;

a user operated control;

a processor operatively connected to the control, the indoor temperature sensor, the outdoor temperature sensor, the first fan, and the second fan, operating the first fan draw indoor air from the room, providing a first air flow past the first temperature sensor and the second fan to draw outdoor air into the room, providing a second air flow past the second temperature sensor, for a sampler period of time;

sensing an indoor air temperature Ti in the first air flow created by the first fan by the first temperature sensor during the sampler period of time;

sensing an outdoor air temperature To in the second air flow created by the second fan by the second temperature sensor during the sampler period of time;

the processor receiving the indoor temperature Ti from the first temperature sensor;

the processor receiving the outdoor temperature To from the second temperature sensor;

the processor comparing the indoor temperature Ti to the target temperature Tt;

the processor comparing the indoor temperature Ti to the outdoor temperature To;

activating the first fan and the second fan to draw outside air into the temperature controlled room if a first criteria comprising in the heating mode, the indoor temperature Ti is less than the target temperature Tt, and the indoor temperature Ti is less than the outdoor temperature To is met;

activating the first fan and the second fan to draw outside air into the temperature controlled room if a second criteria comprising in the cooling mode, the indoor temperature Ti is greater than the target temperature Tt, and the indoor temperature Ti is greater than the outdoor temperature To is met; and deactivating the first fan and the second fan if neither the first criteria nor the second criteria are met.

11. The dual wall mount fan of claim 10, further including periodically testing for the first criteria and the second criteria after a waiting time interval, and activating the first fan and the second fan if either the first criteria or the second criteria is met, otherwise, deactivating the first fan and the second fan.

12. The dual wall mount fan of claim 11, wherein the waiting time is between 15 and 30 minutes.

13. The dual wall mount fan of claim 12, wherein the waiting time is 20 minutes.

14. The dual wall mount fan of claim 10, wherein the sample period of time is between three seconds and 10 seconds.

15. The dual wall mount fan of claim 14, wherein the sample period of time is five seconds.

16. The dual wall mount fan of claim 10, further including:

A user inputting a lower temperature Tl and a higher temperature Th; and deactivating the first fan and the second fan when the indoor temperature Ti is not between the lower temperature Tl and the higher temperature Th.

17. The dual wall mount fan of claim 10, further including mounting the housing in a window.

18. The dual wall mount fan of claim 10, further including attaching the first temperature sensor or the second temperature sensor to and end of a rod extending from the housing, the sensor residing outside the housing.

19. A method for controlling room temperature, comprising:

mounting a dual wall mount fan in a wall of an temperature controlled room, the dual wall mount fan comprising:

an independently controlled first fan in the housing;

an independently controlled second fan in the housing;

a first temperature sensor;

a second temperature sensor;

a user operated control;

a processor operatively connected to the control, the indoor temperature sensor, the outdoor temperature sensor, the first fan, and the second fan, operating the first fan draw indoor air from the room and the second fan to draw outdoor air into the room, for a sampler period of time of five seconds;

sensing an indoor air temperature Ti in an air flow created by the first fan by the first temperature sensor during the sampler period of time;

sensing an outdoor air temperature To in an air flow created by the second fan by the second temperature sensor during the sampler period of time;

the processor receiving the indoor temperature Ti from the first temperature sensor;

the processor receiving the outdoor temperature To from the second temperature sensor;

the processor comparing the indoor temperature Ti to the target temperature Tt;

the processor comparing the indoor temperature Ti to the outdoor temperature To;

activating the first fan and the second fan to draw outside air into the temperature controlled room if a first criteria comprising in the heating mode, the indoor temperature Ti is less than the target temperature Tt, and the indoor temperature Ti is less than the outdoor temperature To is met;

activating the first fan and the second fan to draw outside air into the temperature controlled room if a second criteria comprising in the cooling mode, the indoor temperature Ti is greater than the target temperature Tt, and the indoor temperature Ti is greater than the outdoor temperature To is met;

deactivating the first fan and the second fan if neither the first criteria nor the second criteria are met;

periodically re-testing for the first criteria and the second criteria after a waiting time interval of 20 minutes, and activating the first fan and the second fan if either the first criteria or the second criteria is met, otherwise, deactivating the first fan and the second fan.

* * * * *